United States Patent [19]

Roberts

[11] Patent Number: 4,987,746

[45] Date of Patent: Jan. 29, 1991

[54] APPARATUS FOR TRANSFERRING WATER FROM A CONTAINER TO A REFRIGERATOR ICE MAKER

[76] Inventor: Mark J. Roberts, 6344 E. Frost, Mesa, Ariz. 85205

[21] Appl. No.: 389,574

[22] Filed: Aug. 4, 1989

[51] Int. Cl.[5] ..... F25C 1/00

[52] U.S. Cl. ..... 62/137; 62/233; 62/340; 417/12

[58] Field of Search ..... 62/233, 340, 135; 417/12; 222/56, 642, 643

[56] References Cited

U.S. PATENT DOCUMENTS

| | | | |
|---|---|---|---|
| 3,228,202 | 1/1966 | Cornelius | 62/233 X |
| 3,459,005 | 8/1969 | Sorensen | 62/233 X |
| 3,541,806 | 11/1970 | Jacobs | 62/233 |
| 4,597,270 | 7/1986 | Kerr | 62/340 X |
| 4,750,472 | 6/1988 | Fazekas | 417/12 X |
| 4,815,941 | 3/1989 | Fayo | 62/340 X |

*Primary Examiner*—William E. Tapolcai

*Attorney, Agent, or Firm*—H. Gordon Shields

[57] ABSTRACT

Water is pumped from a container to a refrigerator ice maker and/or chilled water unit. The apparatus for transferring the water includes a motor operated pump, and the motor is connected directly to a timer within the refrigerator. The timer controls the flow of water to the ice maker by controlling the pump so that the pump operates only when the ice maker (and/or chilled water unit) calls for the water. A check valve may be disposed in the pumped water line between the pump and the water source to prevent loss of pressure in the line due to the bleeding of pressure through the pump.

5 Claims, 2 Drawing Sheets

APPARATUS FOR TRANSFERRING WATER FROM A CONTAINER TO A REFRIGERATOR ICE MAKER

BACGROUND OF THE INVENTION

1. Field of the Invention:

This invention relates to the providing of water for an automatic ice maker and a cool water dispenser of a refrigerator and, more particularly, to the pumping of water from a water container rather than from a pressurized water line utilizing a switch controlled pump.

2. Description of the Prior Art:

Refrigerators having ice makers and/or chilled water dispensers are typically connected to a pressurized water line in the structure in which the refrigerator is located. This means that the city water supply, which is the typical source for the pressurized water line, will provide the water for the ice cubes and for drinking. Very often, water in the city water supply is chlorinated, and the chlorine taste is carried through the water lines and into the ice cubes, etc. Moreover, the water typically includes particulates, etc., that cause the ice cubes to be cloudy and, when melted, to leave a residue in the container in which the ice cubes are disposed, such as in glasses, etc. This is often very undesirable.

Alternatives to utilizing city water lines for connection to refrigerators include filling ice cube trays manually from a bottled water dispenser, maintaining containers of cool water in the refrigerator for normal use, using bottled water and coolers, and filters connected to tap water.

An alternative to using a city water line water for automatic ice makers has been suggested in prior art patents, but each of the patents includes certain deficiencies, and those deficiencies are overcome by the apparatus of the present invention.

U.S. Pat. No. 2,675,757 (Moore) discloses an electrically controlled liquid measurer and dispenser. Liquid is pumped into a housing or cylinder. The rising liquid causes a free floating element to rise within the cylinder. The free floating element makes contact with a resilient tube in which is placed two electrical contacts. Movement of the resilient tube by the free floating element causes the electrical contacts to touch, thus closing an electrical circuit to a relay which in turn opens the motor control.

The free floating element has a greater specific gravity than the liquid being pumped into the cylinder. Accordingly, the element will move only when the fluid or liquid is being pumped. When the pump turns off, the element moves by gravity to the bottom of the housing or cylinder. The length or distance that the element moves in the cylinder controls the volume of the liquid to be dispensed.

U.S. Pat. No. 3,796,063 (Wulke et al) discloses a portable ice cube making apparatus in which a water supply is provided from a water source to a reservoir. Water flows by gravity from the reservoir to the ice cube making apparatus.

U.S. Pat. No. 3,969,909 (Barto et al) discloses an alternative to the general prior art discussed above in that it provides for the pumping of water from a water reservoir disposed adjacent to the refrigerator. A switch responsive to water pressure is used to control water pumped from a water source to a reservoir at the top of a refrigerator. Water flows from the reservoir again by means of a pump, to the ice cube maker and to the water dispenser reservoir.

U.S. Pat. No. 3,983,583 (Herman et al) discloses a portable bar system in which a pump is used to pump water from a water container within the portable bar to an ice cube maker and another pump is used to supply a faucet.

U.S. Pat. No. 4,027,499 (Barto et al) is similar to the above discussed '909 patent insofar as the pumping system is concerned. Again, water is pumped from a water supply to a reservoir, and the water is then pumped from the reservoir to an automatic ice maker.

U.S. Pat. No. 4,265,262 (Hotine) discloses a system for sensing and controlling the level of liquid or fluent material in a reservoir or receptacle. There are separate sensors for sensing the low level of the material and the high level of the material. Through a control system, which is the claimed subject matter, pumps for pumping the material into and out of the reservoir are controlled in response to the output signals from the low level sensor and the high level sensor.

U.S. Pat. No. 4,476,889 (Haynes) discloses a control valve for a high pressure fluid system. The control valve includes a check valve and two pressure responsive switches. The pressure responsive switches include a low pressure responsive switch and a high pressure responsive switch. The electrical system is responsive to both of the pressure responsive switches. The control valve in turn is connected to a switch which controls a pump motor.

U.S. Pat. No. 4,597,270 (Kerr) discloses a water reservoir and a pump compartment adjacent to the water reservoir for an ice maker of a refrigerator. The electrical system of the refrigerator is connected directly to the electrical system of the pump for pumping water from the reservoir through a solenoid valve to the ice maker. The pump is actuated when the solenoid valve is actuated. The reservoir is apparently filled by hand. That is, it is not connected to a source of water or to a water supply. Rather, the reservoir apparently is hand filled, and the water is pumped from the reservoir by the pump to and through the solenoid valve in response to the actuation of the solenoid valve.

U.S. Pat. No. 4,848,097 (Roberts), the inventor of which is the inventor herein, discloses an apparatus for pumping water from a container to a refrigerator ice maker which includes a motor operated pump controlled by a pair of switches in series for turning the motor off. The switches include a pressure switch actuated from water pressure in the pumped water line and a switch to indicate when the water level in the container is at or below a certain, predetermined minimum. A check valve in the pumped water line between the pump and the pressure switch for preventing loss of pressure in the line due to the bleeding of pressure through the pump that could otherwise cause the pump to start pumping water when there was no demand for it in the refrigerator.

SUMMARY OF THE INVENTION

The invention described and claimed herein comprises a water pumping system for pumping water from a container to a refrigerator for using the pumped water in an ice maker, a chilled water dispenser, etc. An electric motor for pumping the water is controlled directly by a timer which is an integral part of the refrigerator's ice maker system.

Among the objects of the present invention are the following:

To provide new and useful water pumping apparatus;

To provide new and useful apparatus for pumping water from a container to a refrigerator;

To provide new and useful water pumping apparatus having an electric motor connected to a water pump controlled by a timer within a refrigerator;

To provide new and useful apparatus for providing water for an ice maker in a refrigerator in which control of the apparatus is accomplished by elements in the refrigerator;

To provide new and useful water control apparatus for controlling the flow of water from a water source to an ice maker of a refrigerator; and To provide new and useful apparatus including a refrigerator having an electrical system and a timer in the electrical system for controlling the flow of water to an ice maker in the refrigerator.

DESCRIPTION OF THE PREFERRED EMBODIMENT

Figure 1:
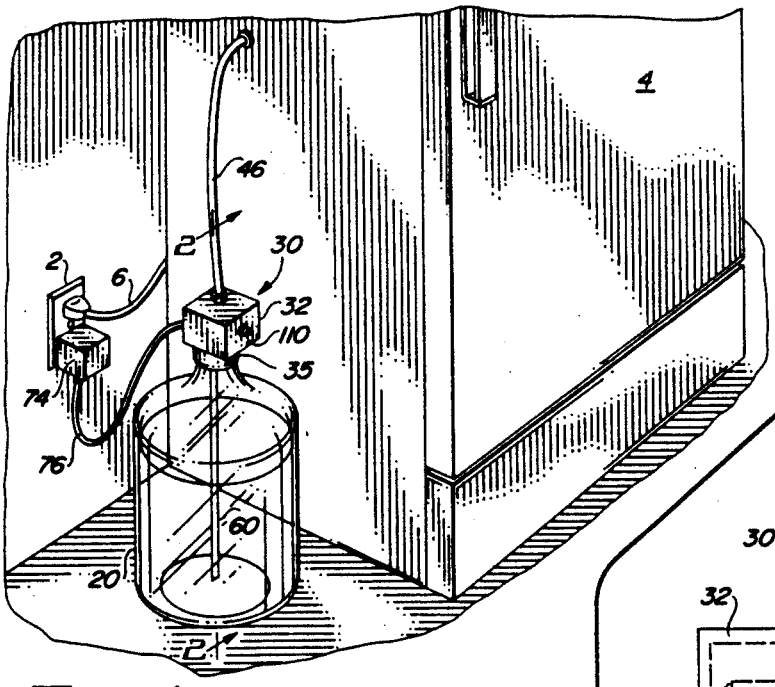
FIG. 1 is a perspective view of the apparatus of the present invention in its use environment.

FIG. 1 is a perspective view of the apparatus of the present invention in its use environment. The use environment includes a wall outlet 2 and a refrigerator 4. The refrigerator 4 is connected to the wall outlet 2 by a line cord 6.

A water container 20 is disposed adjacent to the refrigerator 4 and to the wall outlet 2. Water supply apparatus 30 of the present invention is connected to the water container 2 and to the refrigerator 4.

Figure 3:
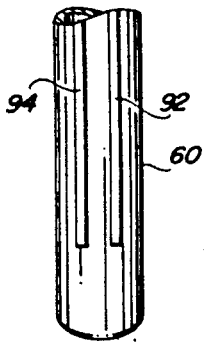
FIG. 3 is an enlarged view taken generally along line 3—3 of FIG. 2.
Figure 2:
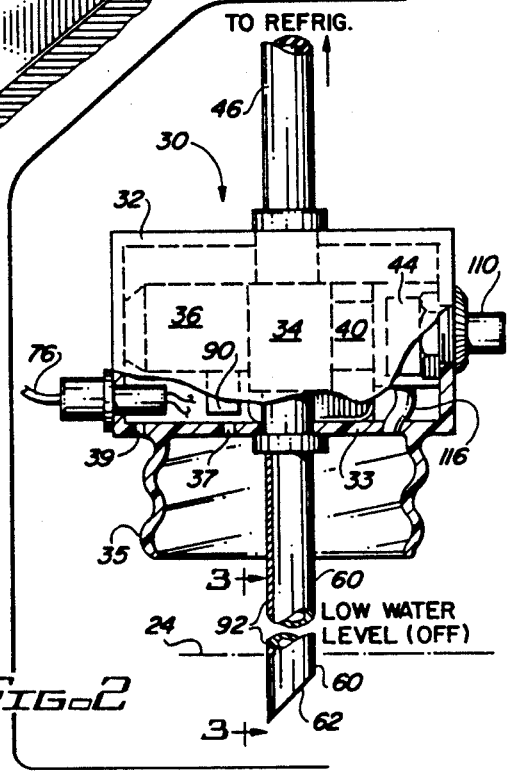
FIG. 2 is an enlarged view in partial section, and partially schematic, taken generally along line 2—2 of FIG. 1.
Figure 4:
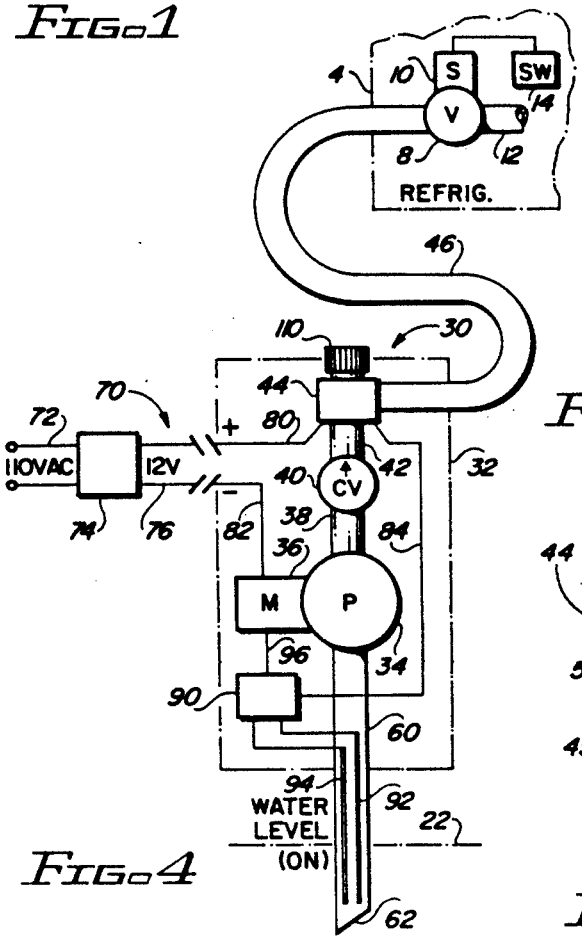
FIG. 4 is a schematic diagram of the apparatus of the present invention illustrating the circuitry involved in the apparatus of the present invention and its use environment.
Figure 5:
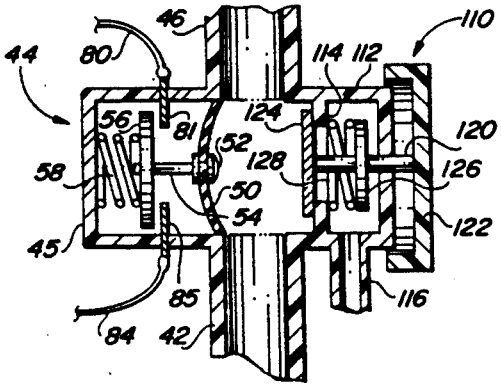
FIG. 5 is a schematic diagram in partial section of a portion of the apparatus of the present invention.

FIG. 2 is an enlarged view in partial section of the water supply apparatus 30 of the present invention. FIG. 3 is an enlarged view of a portion of the water supply apparatus 30 taken generally along line 3—3 of FIG. 2. FIG. 4 is a schematic representation of the water supply apparatus 30 and the refrigerator 4, schematically illustrating both the water supply elements and the electrical elements associated therewith. FIG. 5 is a schematic diagram in partial section of a portion of the apparatus of the present invention, schematically illustrating two of the switches. For the following discussion, reference will be made to all five Figures.

For purposes of the present invention, the water container 20 includes two different water levels, a permissiable or operational water level 22 shown in FIG. 4, and a low water level or unpermissible or inoperable water level 24 illustrated in FIG. 2.

The water supply apparatus 30 of the present invention includes a housing 32 which is disposed on the water container 20. The water container 20 may be an appropriate glass or plastic container which simply holds a quantity of purified/demineralized/bottled water. That is, the water within the container 20 does not include the typical minerals and chemicals found in community water supply systems. The housing 32 is connected to the water container 20 by a flexible skirt connector 35, shown in FIG. 2, which extends downwardly from the housing 32. The skirt 35 is designed to mate, or to be connected, with the neck of the bottle or water container 20.

The housing 32 includes a bottom wall 33. The skirt connector 35 extends downwardly from the bottom wall 33. Extending through the bottom wall 33 are two apertures, an aperture 37, which is disposed within the skirt 35, and an aperture 39, which is outside of the skirt 35. The aperture 37 and the aperture 39 provide atmospheric pressure within the housing 32 and within the water container 20. As will be discussed later, a conduit 116 also extends through the bottom wall 33.

Within the housing 32 is an electric pump 34. The pump 34 is controlled by a motor 36. A water conduit 60 extends downwardly from the pump 34 and the housing 32 and into the water container 20. The conduit 60 terminates in a slant or diagonally cut end 62 adjacent to the bottom of the water bottle 20. From the pump 34, a water conduit 38 extends to a check valve 40. The check valve 40 is a one-way check valve which allows for the flow of water from the pump 34 to the conduit 38 and from the valve 40 to a conduit 42. However, the check valve 40 prevents water from flowing backwards from the conduit 42 to the conduit 38. Thus, when the pump 34 ceases pumping, the check valve 40 assures that the conduit 42 will not be drained of water. The significance of this will be discussed below.

From the conduit 42, water flows by a low pressure control switch 44 and to a conduit 46. The conduit 46 in turn extends to the refrigerator 4. A vent valve or prime switch 110 is also connected to the conduits 42 and 46. The switch 110 will be discussed in more detail below.

The conduit 46 is connected to an ice maker system within the refrigerator 4. In FIG. 1, the conduit 46 is shown extending through a side wall of the refrigerator 4, but this is for illustrative purposes only. As is well known and understood, water connections for ice maker systems within refrigerators are typically through the rear wall of the refrigerator.

As shown in FIG. 4, a typical ice maker system in a refrigerator includes a valve 8 controlled by a solenoid 10, and a water supply line 12 which extends from the valve 8 to an ice maker. The solenoid 10 is controlled by a sensor 14 which senses the need for water. The sensor 14 is typically a mechanical switch which closes when ice cubes are removed or when the level of ice cubes in a container drops below a particular level.

When the solenoid 10 is turned on, the valve 8 opens to allow water to flow through the valve 8 and through the water supply line 12 to the ice maker.

In the apparatus of the present invention, when the valve 8 opens, pressure in the line 46 decreases, and the switch 44 closes to actuate the motor 36 for the pump 34 to provide a flow of water from the conduit 60 to the conduit 46. As will be explained below, the pump 34 is actuated to increase the fluid pressure. When the solenoid 10 turns the valve 8 off, water pressure in the conduit 46 increases. When the pressure increases above a preset maximum, the switch 44 opens and causes the pump 34 to turn off.

The water pressure in the conduit 46, and also in the conduit 42, is maintained because of the check valve 40. As long as the water pressure is maintained across the switch 44, the pump 34 remains off. However, when the valve 8 opens again, to provide additional water to the ice maker, the pressure in line 46 drops and the drop in water pressure is again sensed by the switch 44. The switch 44 turns the pump 34 on by actuating its motor 36.

FIG. 4 comprises a schematic circuit diagram combining the electrical system of the apparatus 30 of the present invention with the water system of both the refrigerator 4 and the apparatus of the present invention. FIG. 4 discloses an electrical system 70 for the water supply apparatus 30. The electrical system 70 includes a line current connection 72 and a transformer 74. The transformer 74 is for the purpose of transforming a 110 volt ac line current down to twelve volts. The transformer 74 also includes a rectifier for providing 12 volt dc power for operating the motor 36. It is obvious that, if desired, the motor 36 could also utilize line current if desired. However, for safety considerations, the utilization of 12 volt dc current may be preferable. Accordingly, the following discussion assumes the utilization of 12 volt dc current for the electrical circuitry 70.

From the transformer 74, a conductor pair 76 extends to the housing 32. At the housing 32, the conductor pair 76 separates into a pair of conductors 80 and 82. The conductor 80 is a positive conductor, and the conductor 82 is a negative or ground conductor. The conductor 80 extends to the pressure sensitive switch 44. From the switch 44, a conductor 84 extends to a water level switch 90. The water level switch 90 includes two conductors, a conductor 92 and a conductor 94. As best shown in FIGS. 2 and 3, conductors 92 and 94 are disposed on the outside of the conduit 60. The bottom of the conductors 92 and 94 are disposed slightly above the bottom or end 62 of the conduit 60. As long as part of the conductors 92 and 94 are disposed beneath the water level 22, current will flow between the conductors 92 and 94 to complete a circuit to the switch 90. This is shown in FIG. 4.

With the conductors 92 and 94 completing a circuit through the switch 90, the conductor 84 is connected by the switch 90 to a conductor 96. The conductor 96 extends from the switch 90 to the motor 36. The conductor 82 extends from the motor 36 to the conductor pair 76 to complete the circuitry for operating the motor 36 and the pump 34.

Thus, with water level 22 above the bottom of the conductors 92 and 94, the electrical circuitry is completed from the transformer 74 to the switch 44, and from the switch 44 through the switch 90 and the motor 36 back to the transformer 74. However, the motor 36 will only be operative when the switch 44 is closed. The opening and closing of the switch 44 depends on the water pressure in the conduit 46, as discussed above and as will be explained below.

In FIG. 2, a low water level 24 is illustrated. The water level 24 is slightly below the bottom of the conductors 92 and 94. Accordingly, the circuit between the conductors 92 and 94 is broken, and the switch 90 will accordingly also be open, disconnecting the conductor 84 from the conductor 96. This opens the circuit and prevents the motor 36 from operating. A user of the apparatus 30 will accordingly have to refill the water container 20 before the apparatus will be able to supply water to the ice maker in the refrigerator 4.

At such time as the water level, such as the water level 22, is above the conductors 92 and 94, as shown in FIG. 4, the switch 44 will be operative to control the motor 36 for the pump 34.

The switch 90, with its conductors 92 and 94, comprises a safety feature which prevents the motor 36 from operating when there is no water to be pumped by the pump 34.

A prime switch 110 is a manual switch, as shown in FIG. 2 and in FIG. 5. It comprises a vent switch or valve to vent air from the conduits 42 and 46 and the pump 34 and the conduit 60 when the pump 34 loses its prime due to loss of water in conduit 60. If or when water drains from the conduit 60, the pump 34 loses its prime and pumps air instead of water. The air must be vented from the pump 34 and the conduit 60 in order to allow the pump 34 to pump water. Obviously, the conduits 38, 42, and 46 are also vented at the same time.

The prime switch 110 will typically be used when a new container 20 is installed if the conduit 60 empties. When the water level 24 in the container 20 is below the level desired, or when the container 20 is effectively empty, the apparatus 30 will be removed from the bottle or container 20 and a new bottle or container full of water will be brought to the refrigerator 4. The apparatus 30 will then be installed on the new container 20, the full container 20, and the prime switch 110 may need to be actuated to prime the pump 34.

When the apparatus 30 is removed from the old container 20, and installed in a new container 20, there may be air in the line or conduit 60. The air in the conduit 60 will be vented to the atmosphere as the switch 110 is actuated, thus allowing the line or conduit 60, and the pump 34, to fill with water. The venting is accomplished through the switch or valve 110 as illustrated in FIG. 5. The air bled from the conduit 60 and from the motor 34, and any water in the conduits 42 and 46, are vented to atmospheric pressure, by returning them to the container 20. The air and water are replaced by water from the new container 20.

If, for some other reason, air is allowed to get into the system so as to cause the pump 34 to lose its prime, the prime switch 110 may be actuated to allow the air to be bled from the system. The air is then replaced by water to provide the priming action for the pump 34.

In FIG. 5, the operation of the low pressure control switch 44 and the operation of the prime switch or vent valve 110 is also illustrated. The following discussion should be reviewed in conjunction with FIGS. 2 and 4, as well as FIG. 5.

Conduits 42 and 46 extend from the check valve 40 upwardly to connect with the refrigerator 4. Water pressure in conduits 42 and 46 is the same, and that pressure will be across switch 44.

Switch 44 includes a housing 45 which is connected to the conduits 42 and 46. Within the housing 45, and essentially at the juncture of the conduits 42 and 46, is a flexible diaphragm 50. The diaphragm 50 includes a pair of plates 52 secured to the center portion of the diaphragm 50. A stem 54 is secured to the pair of plates. The pair of plates is secured on opposite sides of the diaphragm 50, in a well-known manner, and the stem 54 extends outwardly or away from the diaphragm 50 within the housing 45.

Secured to the stem 54, remote from the diaphragm 50, is a conductive plate or element 56. A compression spring 58 is disposed about the stem 54 and extends between an outer end wall of the housing 45 and the plate 56. The compression spring 58 urges the plate 56, and the stem 54 and the diaphragm 50 towards the conduits 42 and 46.

Within the housing 45, and between the conductive plate 56 and the diaphragm 50, is a pair of electrical contacts 81 and 85. The conductor 80 is connected to the conductive element or terminal 81. The conductor 84 is connected to the conductive element or terminal 85. The compression spring 58 urges the conductive plate against the electrical elements or terminals 81 and 85 to complete the electrical circuit between the conductors 80 and 84.

Water pressure in the conduits 42 and 46 biases the diaphragm 50. When the water pressure in the conduits 42 and 46, against the diaphragm 50, is greater than the bias of the compression spring 58, the diaphragm 50 will be flexed away from the conduits 42 and 46 to cause the conductive plate 56 to open the circuit between the conductive elements 81 and 85, thus opening the circuit between the conductors 80 and 84. Accordingly, when the solenoid 10 opens the valve 8 within the refrigerator 4, low water pressure in the conduits 42 and 46 will cause the circuit including the conductors 80 and 84, and their respective terminals 81 and 85, to be closed by the conductive plate 56 under the bias of the compression spring 58. This will cause the motor 36 to operate, as discussed above.

With the motor 36 operating, or turned on, the pump 34 will pump water until the demand for the water in the refrigerator 4 is met. At such time as the demand for the water is met, the valve 8 will be closed by the solenoid 10, and water pressure in the conduits 42 and 46 will increase. The increased water pressure will cause the diaphragm 50 to move against the bias of the spring 58, as discussed above, to open the electrical circuit, and thus to turn the motor 36 off.

The check valve 40 prevents a loss of the water pressure in the conduits 42 and 46, and thus the motor 36, and the pump 34, will be off until pressure drops in the conduits 42 and 46 as the result of the opening of the valve 8 by the solenoid 10.

The prime switch or vent valve 110 is disposed adjacent to the low pressure control switch 44, also adjacent to the juncture of the conduits 42 and 46. The prime switch or vent valve 110 is used to vent the conduits 42 and 46 in the event that the pump 34 loses its prime by the introduction of air into the conduit 60 or the conduit 46, as the case may be. Typically, as water is lost from the conduit 60, thus providing air in the conduit 60, the pump 34 may lose its prime. With the pump 34 losing its prime, it would pump air and continue to run if the vent valve or prime switch 110 were not connected in the water circuit. Obviously, if there is no water in the conduit 46, when the valve or switch 110 is open, the water will flow out of the conduit 46. As shown in FIGS. 2 and 5, the valve or switch 110 is connected by a conduit 116 to allow water to flow back to the water container 20. Similarly, air vented from the conduits 42 and 46 and also from conduits 60 and 38 through the pump 34 and the check valve 40, is also vented to atmospheric pressure through the conduit 116.

The switch or valve 110 includes a housing 112. The housing 112 includes an apertured wall 114 adjacent to the juncture of the conduits 42 and 46.

A rod or stem 120 extends out of the housing 112 remote from the apertured wall 114. The rod or stem includes a cap or button 122 outside of the housing 112 and a valve element 124 within the housing 112 and adjacent to the apertured wall 114. The stem 120 extends through the apertured wall 114 and the valve element 124 is disposed on one end of the stem or rod 120 remote from the cap or button 122.

A spring stop element 126 is secured to the stem 120 within the housing 112. A compression spring 128 is disposed about the stem 120 and it extends between the wall 114 and the spring stop element 126. The compression spring 128 urges the valve element 124 against the aperture in the wall 114 to seal the aperture. It is only when the cap or bottom 122 is manually depressed that the valve element 124 is moving away from the aperture in the wall 114 to provide communication between the conduits 42 and 46 that either air or water is able to flow from the conduits 42 and/or 46 through the apertured wall 114, and into the housing 112 and outwardly from the housing 112 through the conduit 116. Thus, positive action by a user of the apparatus 30 is required in order to vent the apparatus to allow the pump 34 to be primed when it has lost its prime due to air getting into the conduit 60 and the pump 34.

An appropriate seal will, of course, be provided for the stem 120 as it extends through an end wall of the housing 112.

If desired, lights could be used to provide an indication of the operation of the pump 34 (or its motor 36), and an indication of the low water state. Moreover, if desired, the housing 32 may be disposed adjacent to the bottle 20, instead of on top of it. In such case, only the conduit 60 would extend into the bottle 20. Also, the pump 34 and its motor 36 and the associated elements may be built into the refrigerator 4, if desired. In such case, the solenoid controlled valve may be omitted, and the sensing elements in the refrigerator's ice making system may be tied or coupled directly to the pump motor to cause the pump motor to pump water as required by the ice making system.

The apparatus of FIGS. 1–5 comprises a totally "add-on" system for supplying unpressurized water to a refrigerator. The apparatus of FIGS. 1–5 assumes that the only connection externally to the refrigerator 4 is a water input connection whereby a source of unpressured water may be connected directly to the ice maker unit in the refrigerator. In the apparatus of FIGS. 6–11, part of the circuitry involved in controlling an external source of water is built into the refrigerator itself. That is, it is assumed by the maker of the refrigerators involved that a special water supply source may be connected to the refrigerator, as for example, the bottle 20 of FIG. 1. The connection of the external water supply source is accordingly simplified by enabling the necessary elements to provide water for the refrigerator to be connected directly to the refrigerator itself, rather than to the wall outlet 2, shown in FIG. 1.

Figure 6:
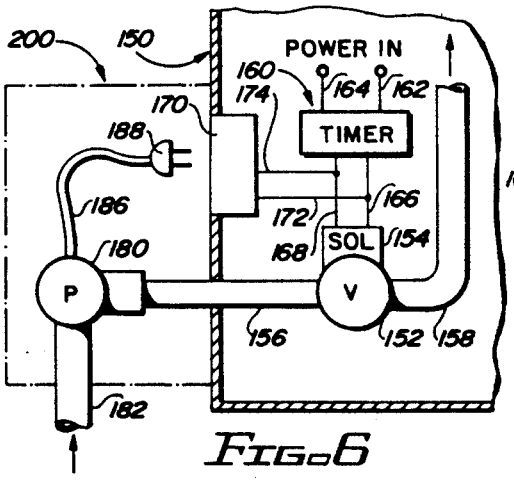
FIG. 6 is a view in partial section schematically illustrating an alternate embodiment of the apparatus of the present invention.

FIG. 6 is an alternate embodiment of the apparatus of the present invention in which a refrigerator 150 is shown in partial section, and various control elements are schematically illustrated within the refrigerator 150. External elements connected directly to the refrigerator 150 are appropriately secured to the refrigerator by means of a housing 200 in which the external elements are disposed.

The refrigerator 150 includes a valve 152 controlled by a solenoid 154. The valve 152 includes an input conduit 156 which is appropriately connected to an external water supply. Water from the input conduit 156 flows through the valve 152 in response to the solenoid 154 and through a conduit 158 from the valve 152 to the ice maker within the refrigerator 150.

A timer 160 is disposed within the refrigerator as part of the ice maker. The timer 160 includes a pair of electrical input conductors 162 and 164. The timer 160 is in turn connected to the solenoid 154 through a pair of conductors 166 and 168. The timer 160 controls the length of time that the solenoid 154 is actuated to allow water to flow through the valve 152.

An electrical outlet or receptacle 170 is secured to the outer wall of the refrigerator 150 to enable an electrical plug to be connected to the timer 160. A pair of conductors 172 and 174 extend from the conductors 166 and 168, respectively, to provide electric current to the receptacle 170 in response to the operation of the timer. Thus, both the solenoid 154 and the receptacle or socket 170 are "hot" at the same time.

Within the housing 200 is a pump 180. The pump 180 is connected to the water conduit 156 to provide water through the valve 152 and the conduit 158 to the ice maker within the refrigerator 150. Another conduit 182, a supply conduit to the pump 180, extends from the pump 180 to an external source of water, such as the container or reservoir 20 of FIG. 1.

The pump 180 is electrically connected to the electrical circuitry of the refrigerator 150 through a conduit 186 and a plug 188. The plug 188 plugs directly into the receptacle or socket 170.

In operation, when the appropriate sensor within the ice maker of the refrigerator 150 indicates that water is needed for making ice cubes, an appropriate signal is sent to the timer 160 through the leads or electrical conductors 162 and 164. The timer 160 turns on so as to connect both the solenoid 154 and the pump 180 to allow the pump 180 to supply water from the conduit 182 to the conduit 156, and through the valve 152 to the conduit 158 and on to the ice maker. When a predetermined amount of water has been provided, the timer 160 turns off, thus disconnecting electrical power to the solenoid 154 and the pump 180. It will be noted that the timer 160 is preferably a variable timer in order that it may be adjusted to provide a sufficient amount of water in response to the particular output capability of the pump 180.

Figure 7:
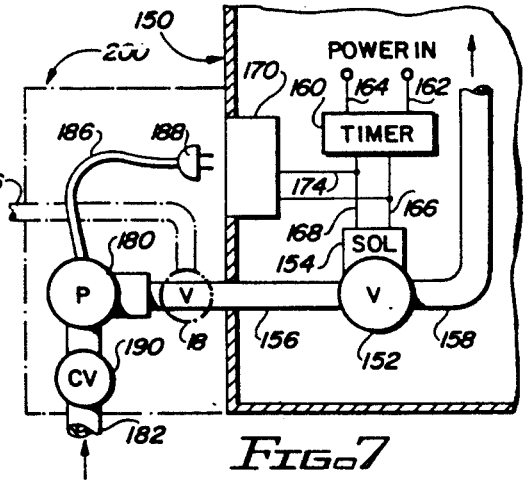
FIG. 7 is a view in partial section schematically illustrating an alternate embodiment of the apparatus of FIG. 6.

FIG. 7 is a schematic representation of the refrigerator 150 and the housing 200, which are substantially the same as that disclosed in FIG. 6. However, a check valve 190 is shown in FIG. 7 disposed in the conduit 182. The check valve 190 is a one way check valve that allows the flow of water only upwardly through the conduit 182 to the pump 180. At such time as the pump 180 shuts off, the check valve 190 closes to prevent water from flowing backwardly or downwardly from the pump 180 into the conduit 182.

Under some circumstances, the system of FIG. 6 or of FIG. 7 may be desirable. In FIG. 6, no check valve is disclosed. In FIG. 7, the check valve 190 is disclosed.

Figure 8:
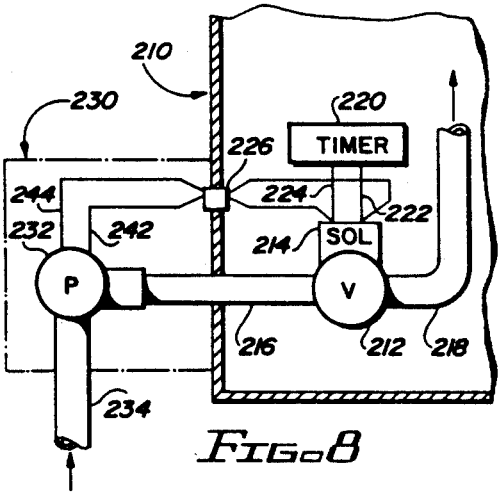
FIG. 8 is a view in partial section schematically illustrating another alternate embodiment of the apparatus of the present invention.

FIG. 8 is a view in partial section of a refrigerator 210 disclosing an alternate embodiment of the apparatus of the present invention, and specifically an alternate embodiment of the apparatus of FIG. 6. In FIG. 8, refrigerator 210 includes a valve 212 controlled by a solenoid 214. The valve 212 is connected to a water input conduit 216 and to a water output conduit 218. The conduit 218 extends to the ice maker of the refrigerator 210. A timer 220 is in turn connected to a solenoid 214. A pair of conductors 222 and 224 extend from the timer 220 to the solenoid 214. The conductors 222 and 224 are connected to appropriate terminals at the solenoid 214. The terminals on the solenoid 214 to which the conductors 222 and 224 are connected are double terminals to which additional conductors may be connected. The pump housing 230, shown in dotted line, may be appropriately connected to the refrigerator 210. Within the housing 230 is a pump 232. The pump 232 is connected to a water input conduit 234 and to the conduit 216 which extends to the valve 212. Thus, water pumped from the conduit 234 by the pump 232 flows through the conduit 216, the valve 212, and the conduit 218 to the ice maker within the refrigerator 210.

Electrical control of the pump 232 is accomplished by means of a pair of electrical conductors 242 and 244. The conductors 242 and 244 extend through a grommet 226 in the wall of the refrigerator 210. The conductors 242 and 244 are routed directly to the solenoid 214 and are connected to the terminals adjacent to the connectors 222 and 224, respectively. Thus, the double terminals of the solenoid 214 allow for the direct connection of the conductors 222 and 224 from the timer 220 and the conductors 222 and 224 from the pump 232. Obviously, the conductors 242 and 244 could also be connected directly to the conductors 222 and 224, if desired, as with "Scotch-Lok" type connectors or the like. In this manner, both the solenoid 214 and the pump 232 are actuated at the same time, and under substantially the same control system as discussed above in conjunction with the apparatus of FIGS. 6 and 7.

Figure 9:
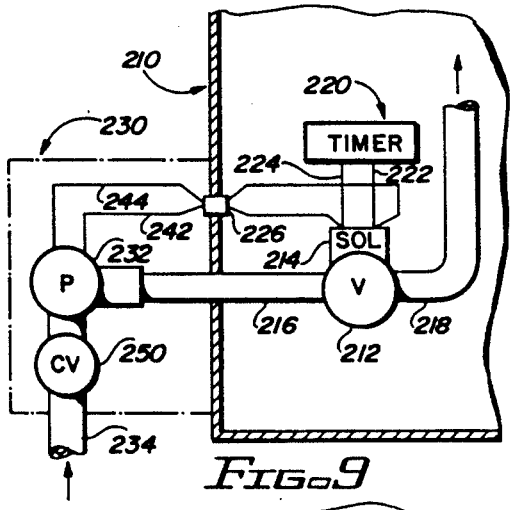
FIG. 9 is a view in partial section schematically illustrating an alternate embodiment of the apparatus of FIG. 8.

FIG. 9 comprises an alternate embodiment of the apparatus of FIG. 8. The difference between the two embodiments is the inclusion of a check valve 250 in the embodiment of FIG. 9. The check valve 250 renders the embodiment of FIG. 9 substantially identical in function to the apparatus of FIG. 7. In both cases, if there is a need for a check valve to prevent water from draining back through the respective pumps, the check valves will accomplish the needed function.

Figure 10:
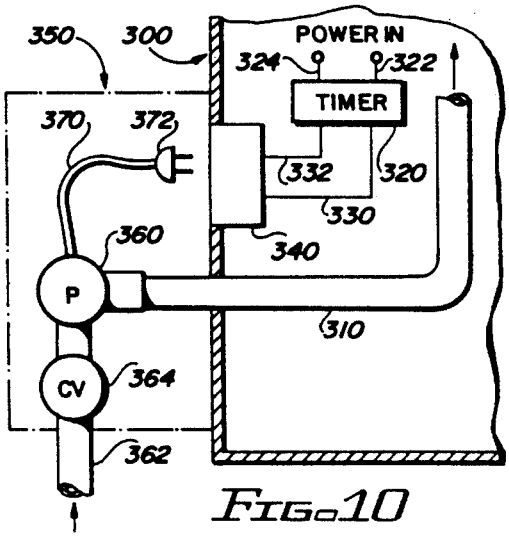
FIG. 10 is a view in partial section schematically illustrating another alternate embodiment of the apparatus of the present invention.

FIG. 10 is a view in partial section schematically illustrating a refrigerator 300 and the various elements to connect an external water supply to an ice maker within the refrigerator 300.

Within the refrigerator 300 is a conduit 310 which extends to the ice maker within the refrigerator 300. It will be noted that the conduit 310 is directly connected to the ice maker without a valve element.

Also disposed within the refrigerator 300 is a timer 320. A pair of conductors 322 and 324 is connected to the timer 320. Another pair of conductors 330 and 332 extend from the timer 320 to a receptacle or outlet 340 at one wall of the refrigerator 300. The outlet or receptacle 340 allows for the direct connection of an external pump to be connected to the timer 320 for providing water through the conduit 310 to the ice maker.

A housing 350 is illustrated in dotted line as being connected to the refrigerator about the receptacle 340. Within the housing 350 is a pump 360. The outlet of the pump 360 is directly connected to the conduit 310. An inlet or water supply conduit 362 is also connected to the pump 360. A one way check valve 364 is disposed in the conduit 362 to prevent water from flowing backwards through the pump 360 when the pump 360 is not operating. A cord 370 extends between the pump 360 and a plug 372. The plug 372 plugs directly into the outlet or receptacle 340 to connect the pump 360 to the timer 320.

When the timer is actuated, current flows through the conductors 330 and 332 and the plug 372 and conductors within the cord 370 to cause the pump 360 to operate. Water is accordingly pumped through the conduit 362 and the conduit 310 to the ice maker within the refrigerator 300. When the timer 320 turns off, the pump 360 also turns off since the timer 320 controls the current flowing through the conductors 330 and 332. Again, as with the embodiments of FIGS. 6, 7, 8, and 9, the timer 320 is a variable timer to allow for the adjustment of the on time of the pump 360 in accordance with the pumping capabilities of the pump 360 and the demand of the ice maker to which the conduit 310 is connected.

Figure 11:
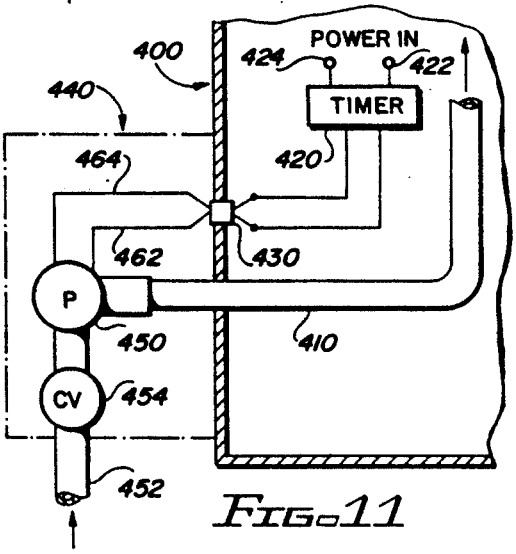
FIG. 11 is a view in partial section schematically illustrating an alternate embodiment of the apparatus of FIG. 10.

FIG. 11 discloses an alternate embodiment of the apparatus of FIG. 10. A refrigerator 400 is schematically illustrated in FIG. 11. As with the refrigerator 300, the refrigerator 400 includes a water conduit 410 which extends directly to the ice maker within the refrigerator 400. The refrigerator 400 also includes a timer 420. The timer 420 is connected at least to a pair of conductors 422 and 424 to provide power to the timer 420.

A housing 440 is shown in dotted line connected to the refrigerator 400. Within the housing 440 is a pump 450. An input conduit 452 extends from the pump 450 to an external source of water. A one way check valve 454 is disposed in the conduit 452 adjacent to the pump 450 to prevent the back flow of water through the pump 450 when the pump is not operating. The output from the pump 450 is connected directly to the conduit 410.

The pump 450 is connected to a pair of conductors 462 and 464 which extend to a grommet 430 in the wall of the refrigerator 400. The conductors 462 and 464 extend directly to terminals on the exterior of the timer 420. Thus, the conductors 462 and 464 extend directly between the pump 450 and the timer 420, or directly between the timer 420 and the pump 450.

In the embodiment of FIG. 11, the necessity for a separate line cord, plug, and receptacle or outlet, with the conductors between the receptacle or outlet and the timer are eliminated. Rather, the conductors connected to the pump extend directly to the timer 420. The provision of the grommet 430 in the wall of the refrigerator 400 allows the conductors 462 and 464 to conveniently extend into the interior of the refrigerator 400 to wherever the timer 420 is located.

It will be noted that the check valves in FIGS. 7, 9, 10, and 11 are upstream from the pumps, or are between the water source and the pump. If desired, the check valves may also be downstream from the pumps.

Returning again to FIG. 7, a conduit 16 is shown in phantom. The conduit 16 extends to the water intake conduit 156. A selector valve 18 is also shown in phantom at the juncture of conduits 16 and 156. If desired, the conduit 16 may be connected to the pressurized water supply of the home or building in which the refrigerator 150 is disposed. The valve 18 allows the user to selectively connect the desired water supply to the refrigerator 150, a bottled water supply through the conduit 182 or the city water supply through the conduit 16. If the city water supply is selected, the pump 180 is not required. A check valve (not shown) may be required in the conduit 16 upstream from the selector valve 18.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Apparatus for providing water to a refrigerator, comprising, in combination:

a refrigerator;

ice maker means within the refrigerator for providing ice cubes;

conduit means for connecting an unpressurized external source of water to the ice maker means;

first electrical means in the refrigerator for providing electrical current in the refrigerator;

timer means connected to the first electrical means for providing current for a predetermined length of time;

means for actuating the timer means in response to the demand for water from the ice maker means;

pump means connected to the conduit means for providing a flow of water from the external source to the ice maker means; and second electrical means in the refrigerator for connecting the first electrical means to the pump means through the timer means for providing an electric current to the pump means for a predetermined length of time.

2. The apparatus of claim 1 in which the conduit means includes valve means connected to the timer means for controlling the flow of water from the external source to the ice maker means.

3. The apparatus of claim 1 in which the pump means further includes check valve means for preventing water from flowing backwardly through the pump means.

4. The apparatus of claim 1 in which the first electrical means includes an electrical outlet, and the second electrical means includes a plug adapted to be connected to the electrical outlet for providing electric current to the pump means.

5. The apparatus of claim 1 in which the conduit means includes a solenoid controlled valve connected to the timer means for controlling the flow of water.

* * * * *